US009038299B1

(12) United States Patent
Uribe

(10) Patent No.: US 9,038,299 B1
(45) Date of Patent: May 26, 2015

(54) FLUID-FILLED BARRIER ASSEMBLY

(71) Applicant: Jimmy L. Uribe, Tehachapi, CA (US)

(72) Inventor: Jimmy L. Uribe, Tehachapi, CA (US)

( * ) Notice: Subject to any disclaimer, the term of this patent is extended or adjusted under 35 U.S.C. 154(b) by 0 days.

(21) Appl. No.: 14/012,707

(22) Filed: Aug. 28, 2013

(51) Int. Cl.
*G09F 15/00* (2006.01)
*E01F 9/012* (2006.01)
*E01F 13/02* (2006.01)

(52) U.S. Cl.
CPC ..... *E01F 9/0124* (2013.01); *E01F 13/02* (2013.01)

(58) Field of Classification Search
CPC ..... G09F 15/0062; E01F 9/0122
USPC ..... 404/6; 138/177; 52/2.11
See application file for complete search history.

(56) References Cited

U.S. PATENT DOCUMENTS

| | | | | |
|---|---|---|---|---|
| 3,795,220 | A | 3/1974 | Hengesbach | |
| 4,465,262 | A * | 8/1984 | Itri et al. | 256/24 |
| 4,852,511 | A | 8/1989 | Look et al. | |
| 5,088,680 | A | 2/1992 | Farmer | |
| 5,269,623 | A * | 12/1993 | Hanson | 404/6 |
| 5,498,101 | A | 3/1996 | Braverman | |
| 5,704,164 | A * | 1/1998 | Huang | 49/55 |
| 5,777,266 | A * | 7/1998 | Herman et al. | 174/68.1 |
| 5,860,386 | A | 1/1999 | Schwab et al. | |
| 6,129,120 | A * | 10/2000 | Margot | 138/121 |
| 6,651,826 | B1 * | 11/2003 | Schiffman | 211/40 |
| 6,718,672 | B1 * | 4/2004 | Wieringa | 40/612 |
| D569,992 | S | 5/2008 | Christensen et al. | |
| 7,448,400 | B2 * | 11/2008 | Jensen | 135/121 |
| 2006/0013650 | A1 * | 1/2006 | Meidan | 404/6 |
| 2009/0107020 | A1 * | 4/2009 | Aires | 40/610 |
| 2013/0233435 | A1 * | 9/2013 | Henthorn et al. | 138/155 |

* cited by examiner

*Primary Examiner* — Shin Kim

(57) ABSTRACT

A fluid-filled barrier assembly restricts access to areas and redirects traffic while ensuring that the assembly remains upright and visible. The assembly includes a plurality of pipes coupled together to define a barrier. The barrier is configured for mounting a sign thereto. A hollow interior of the barrier defines a conduit. The conduit extends through each of the pipes. The conduit is configured for receiving a fluid therein wherein the fluid retains the barrier in an upright position on a supporting surface.

19 Claims, 4 Drawing Sheets

FLUID-FILLED BARRIER ASSEMBLY

BACKGROUND OF THE DISCLOSURE

Field of the Disclosure

The disclosure relates to barrier assemblies and more particularly pertains to a new barrier assembly for restricting access to areas and redirecting traffic while ensuring that the assembly remains upright and visible.

SUMMARY OF THE DISCLOSURE

An embodiment of the disclosure meets the needs presented above by generally comprising a plurality of pipes coupled together to define a barrier. The barrier is configured for mounting a sign thereto. A hollow interior of the barrier defines a conduit. The conduit extends through each of the pipes. The conduit is configured for receiving a fluid therein wherein the fluid retains the barrier in an upright position on a supporting surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
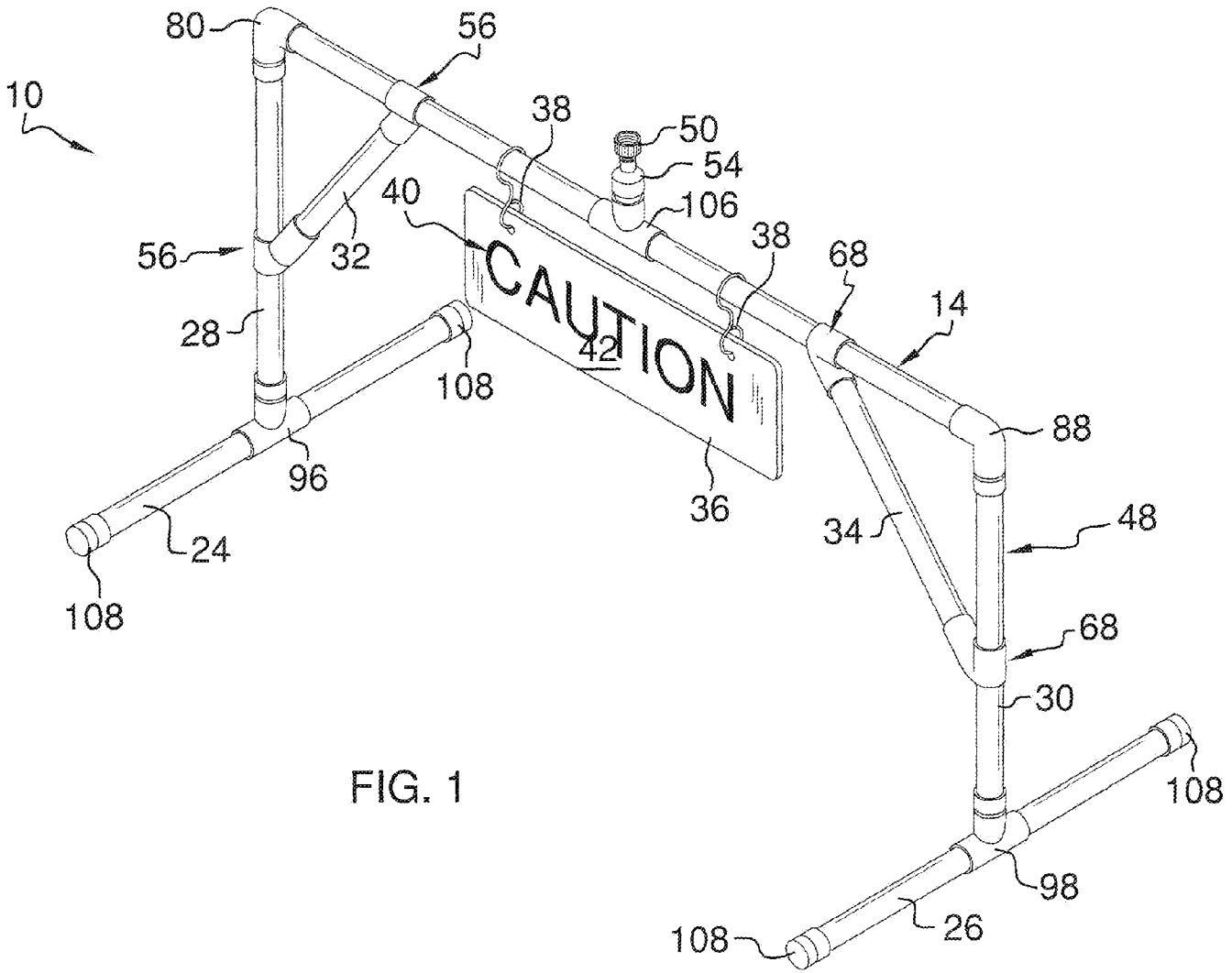
FIG. 1 is a top front side perspective view of a fluid-filled barrier assembly according to an embodiment of the disclosure.
Figure 2:
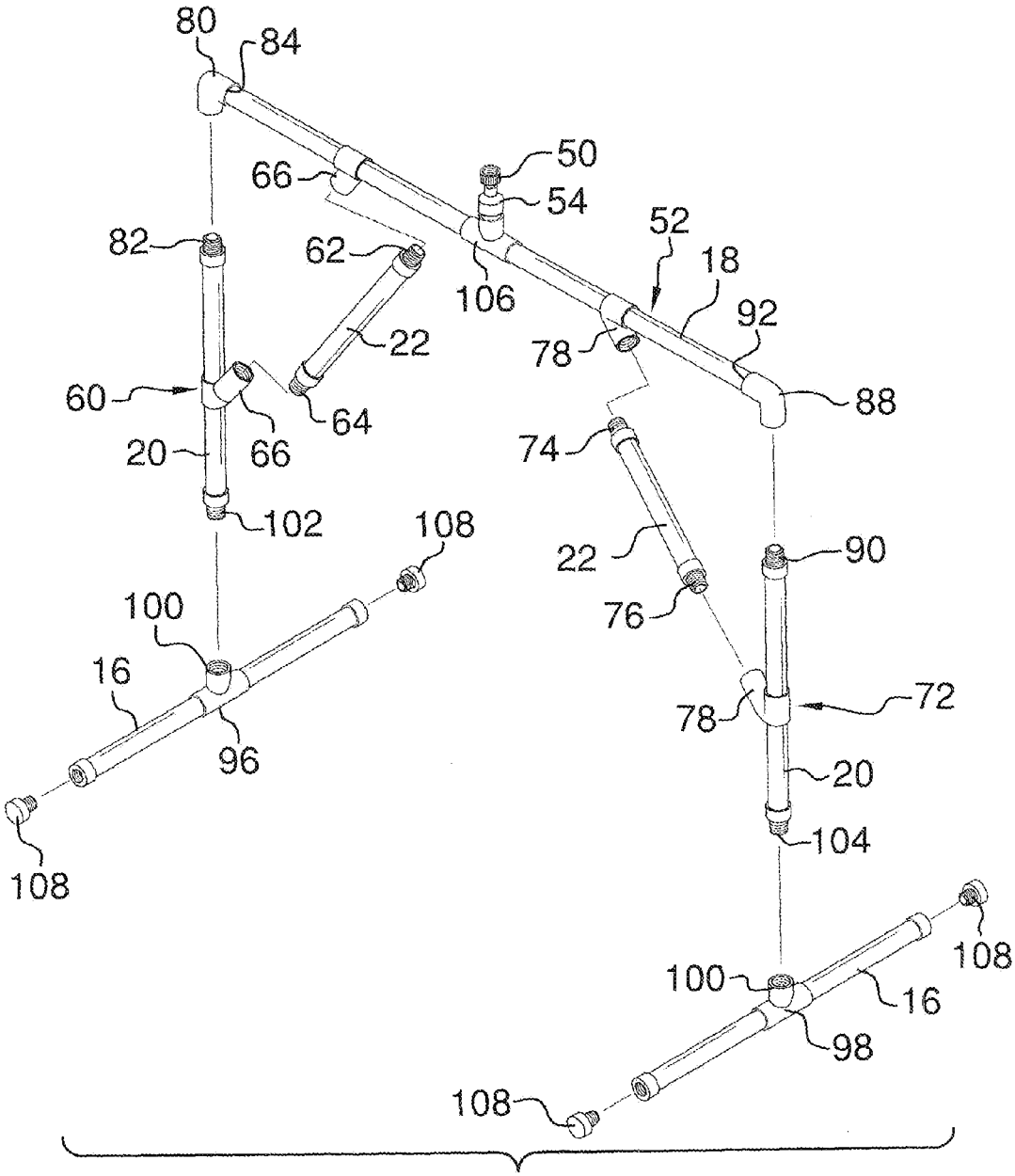
FIG. 2 is an exploded top front side perspective view of an embodiment of the disclosure.
Figure 3:
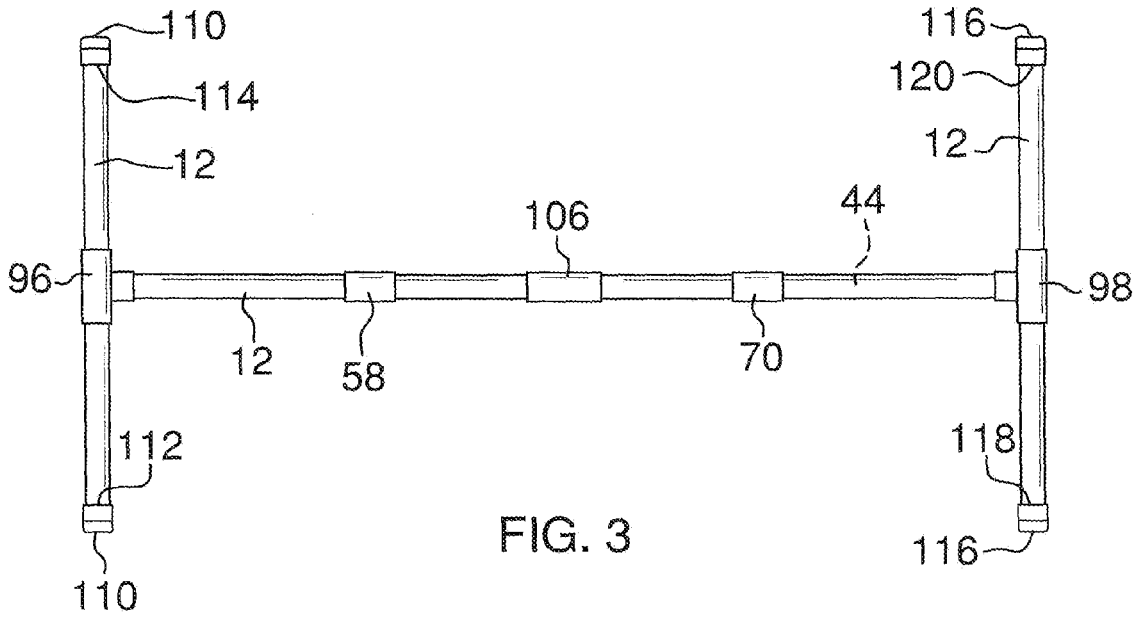
FIG. 3 is a bottom view of an embodiment of the disclosure.
Figure 4:
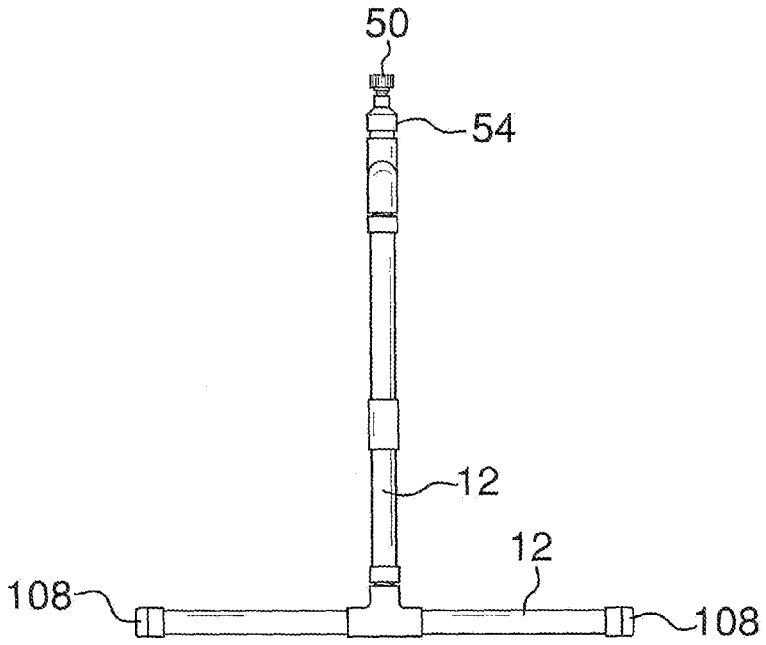
FIG. 4 is a side view of an embodiment of the disclosure.
Figure 5:
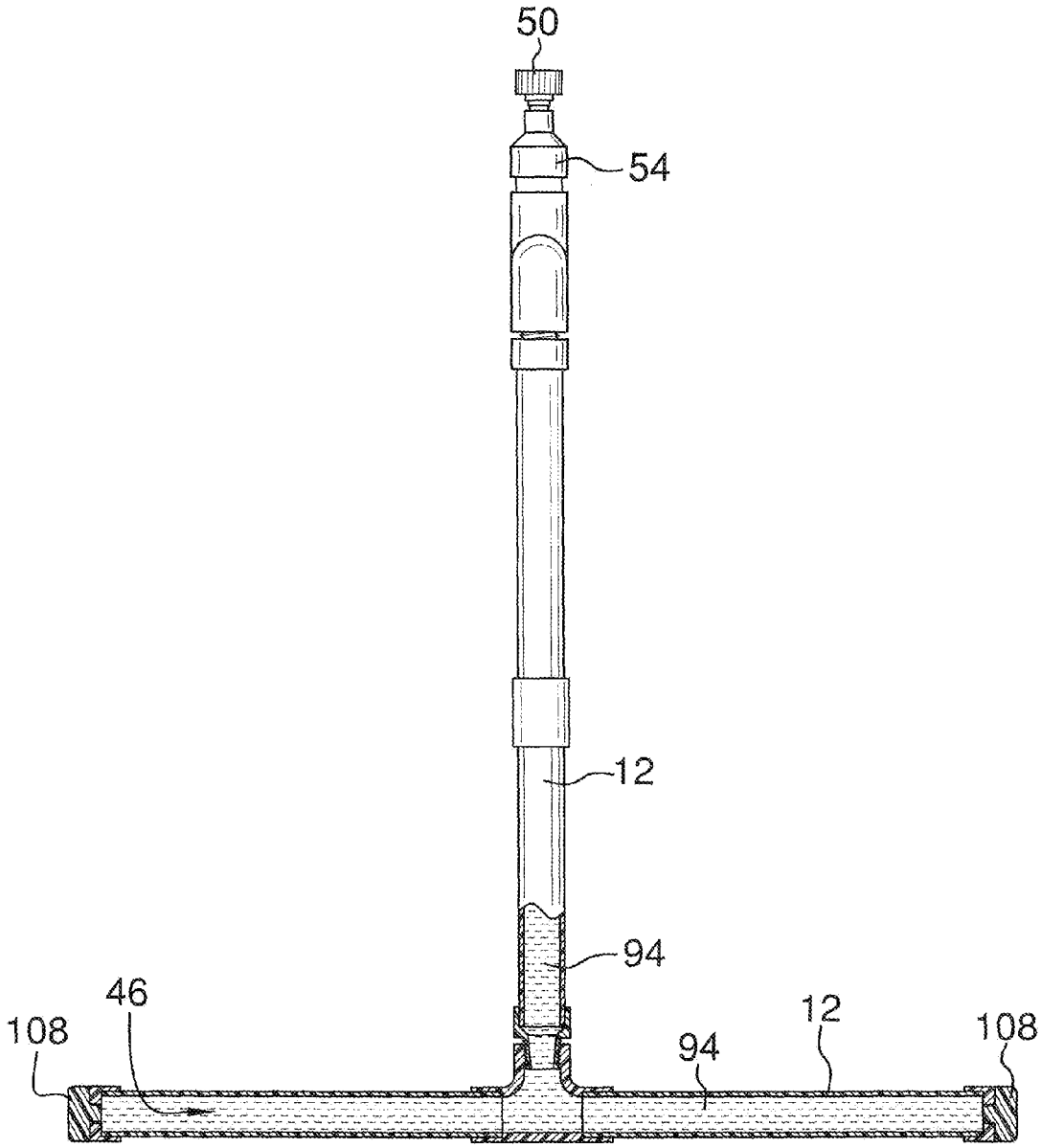
FIG. 5 is a partial cut-away end view of an embodiment of the disclosure.

With reference now to the drawings, and in particular to FIGS. 1 through 5 thereof, a new barrier assembly embodying the principles and concepts of an embodiment of the disclosure and generally designated by the reference numeral 10 will be described.

As best illustrated in FIGS. 1 through 5, the fluid-filled barrier assembly 10 generally comprises a plurality of pipes 12 coupled together to define a barrier 14. The barrier 14 may be used to block off sidewalks, buildings, or like locations, or may otherwise be used to direct traffic. The pipes 12 may be painted in a highly visible color to draw attention to the barrier 14. Lightweight pipes 12, such as PVC pipes or the like, may be used to construct the barrier 14 to facilitate portability of the barrier 14.

Each of the pipes 12 is removably coupled to an adjacently positioned one of the pipes 12. The plurality of pipes 12 includes a pair of base pipes 16, a cross-pipe 18, a pair of intermediate pipes 20, and a pair of supplementary pipes 22. The base pipes 16 comprise a first base pipe 24 and a second base pipe 26. The base pipes 16 are configured for positioning on a supporting surface. The cross-pipe 18 is coupled to and extends between the base pipes 16. Each of the intermediate pipes 20 is coupled to and extends vertically between the cross-pipe 18 and an associated one of the base pipes 16. The intermediate pipes 20 comprise a first intermediate pipe 28 and a second intermediate pipe 30. Each of the base pipes 16 is pivotally coupled to an associated one of the intermediate pipes 20. In this manner, the base pipes 16 may be pivoted between a storage position and a use position wherein the base pipes 16 are positioned perpendicular with respect to the cross-pipe 18 in the use position and are positioned parallel with respect to the cross-pipe 18 in the storage position. Thus, the base pipes 16 may be pivoted to the storage position so that the barrier 14 can be stored flat or may be pivoted to the use position to support the barrier 14 in an upright position 48 against the supporting surface. Each of the supplementary pipes 22 is coupled to and extends between an associated one of the intermediate pipes 20 and the cross-pipe 18. The supplementary pipes 22 comprise a first supplementary pipe 32 and a second supplementary pipe 34. The supplementary pipes 34 slant upwardly toward the cross-pipe 18.

A sign 36 is mounted to the barrier 14. The sign 36 may be suspended from the cross-pipe 18. A pair of hanging supports 38 is coupled to the cross-pipe 18 and couples the sign 36 to the cross-pipe 18. Indicia 40 may be positioned on a front surface 42 of the sign 36. The indicia 40 is configured to communicate a warning message to a viewer of the front surface 42. For example, the words "Caution", "Danger" or the like may be provided on the front surface 42.

A hollow interior 44 of the barrier 14 defines a conduit 46. The conduit 46 extends through each of the pipes 12. The conduit 46 is configured for receiving a fluid 94 therein wherein the fluid 94 retains the barrier 14 in an upright position 48 on the supporting surface. Thus, the fluid 94 weighs down the barrier 46 to help prevent the barrier 46 from being blown or otherwise knocked over. An inlet port 50 is coupled to the cross-pipe 18 and may extend upwardly from a top side 52 of the cross-pipe 18. The inlet port is configured for fluidly coupling to a fluid supply wherein fluid 94 passes into the conduit 46 through the inlet port 50. A valve 54 is coupled to the inlet port 50. The valve 54 is in fluid communication with the inlet port 50 and the conduit 46 wherein the valve 54 regulates flow of the fluid 94 through the valve 54.

A first set of collars 56 fluidly couples the cross-pipe 18 to the first intermediate pipe 28. The first set of collars 56 comprises an upper collar 58 coupled to the cross-pipe 18 and a lower collar 60 coupled to the first intermediate pipe 28. The first supplementary pipe 32 has a first end 62 couplable to the upper collar 58 and a second end 64 couplable to the lower collar 60. Each of the upper 58 and lower 60 collars has a projecting portion 66 that may be threadably couplable to an associated one of the first 62 and second 64 ends of the first supplementary pipe 32. A second set of collars 68 fluidly couples the cross-pipe 18 to the second intermediate pipe 30. The second set of collars 68 comprises a top collar 70 coupled to the cross-pipe 18 and a bottom collar 72 coupled to the second intermediate pipe 30. The second supplementary pipe 34 has a first end 74 couplable to the top collar 70 and a second end 76 couplable to the bottom collar 72. Each of the top 70 and bottom 72 collars has a projecting member 78 that may be threadably couplable to an associated one of the first and second ends of the second supplementary pipe 34.

A first coupler 80 fluidly couples a first end 82 of the first intermediate pipe 28 to a first end 84 of the cross-pipe 18. The first end 82 of the first intermediate pipe 28 may be threadably couplable to the first coupler 80. The first coupler 80 may be arcuate, Similarly, a second coupler 88 fluidly couples a first end 90 of the second intermediate pipe 30 to a second end 92 of the cross-pipe 18. The first end 90 of the second intermediate pipe 30 may be threadably couplable to the second coupler 88. The second coupler 88 may also be arcuate.

A first connector 96 fluidly couples the first base pipe 24 to the first intermediate pipe 28. A second connector 98 fluidly couples the second base pipe 26 to the second intermediate pipe 30. Each of the first 96 and second 98 connectors has a medial portion 100. The medial portion 100 of the first connector 96 may be threadably couplable to a second end 102 of the first intermediate pipe 28. The medial portion 100 of the second connector 98 may be threadably couplable to a second end 104 of the second intermediate pipe 30. A third connector 106 fluidly couples the cross-pipe 18 to the valve 54. Each of the first connector 96, the second connector 98 and the third connector 106 may be T-shaped.

A plurality of end caps 108 is provided. The end caps 108 comprise a first set 110 of end caps 108 coupled to opposite ends 112, 114 of the first base pipe 24 and a second set 116 of end caps 108 coupled to opposite ends 118, 120 of the second base pipe 26. The end caps 108 are removably coupled to associated ones of the base pipes 16 wherein the end caps 108 are configured to drain fluid 94 from the conduit 46 when the end caps 108 are removed from the associated base pipes 16. The end caps 108 may be threadably coupled to the base pipes 16.

Each of the pipes 12 may have a diameter between approximately 2.5 centimeters and 20.0 centimeters. The barrier 14 may have a length between approximately 95.0 centimeters and 200.0 centimeters. The barrier 14 may have a height and a width between approximately 45.0 centimeters and 90.0 centimeters. A plurality of barriers 14 may be provided and positioned adjacently if the length of one barrier 14 is insufficient for a particular purpose.

In use, as stated above and shown in the Figures, the pipes 12 are coupled together to form the barrier 14 as described above. The barrier 14 is then placed in an upright position 48 on a supporting surface. The end caps 108 are coupled to the base pipes 16, while the inlet port 50 is coupled to a fluid supply so that fluid 94 passes into the conduit 46 through the inlet port 50. The fluid 94 weighs down the barrier 14 and helps to retain the barrier 14 in the upright position 48. The sign 36 is mounted to the barrier 14 and helps to redirect traffic or restrict access to an area. The end caps 108 are removed to drain the fluid 94 from the barrier 14. The base pipes 16 are pivoted to the storage position in order to store the barrier 14 more compactly.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A fluid-filled barrier assembly comprising:

a plurality of pipes coupled together to define a barrier, said barrier being configured for mounting a sign thereto;

a hollow interior of said barrier defining a conduit, said conduit extending through each of said pipes, said conduit being configured for receiving a fluid therein wherein the fluid retains said barrier in an upright position on a supporting surface;

a pair of base pipes, said base pipes comprising a first base pipe and a second base pipe, said base pipes being configured for positioning on a supporting surface; and a cross-pipe coupled to and extending between said first and second base pipes;

an inlet port being coupled to said cross-pipe, said inlet port being configured for fluidly coupling to a fluid supply wherein fluid passes into said conduit through said inlet port.

2. The assembly of claim 1, further comprising each of said pipes being removably coupled to an adjacently positioned one of said pipes.

3. The assembly of claim 1, said pipes further including a pair of intermediate pipes, each of said intermediate pipes being coupled to and extending vertically between said cross-pipe and an associated one of said base pipes.

4. The assembly of claim 3, further comprising each of said base pipes being pivotally coupled to an associated one of said intermediate pipes.

5. The assembly of claim 3, said pipes further including a pair of supplementary pipes, each of said supplementary pipes being coupled to and extending between an associated one of said intermediate pipes and said cross-pipe, said supplementary pipes slanting upwardly toward said cross-pipe.

6. The assembly of claim 1, further comprising a valve coupled to said inlet port, said valve being in fluid communication with said inlet port and said conduit wherein said valve regulates flow of the fluid through said valve.

7. The assembly of claim 5, further comprising:

said intermediate pipes including a first intermediate pipe;

said supplementary pipes including a first supplementary pipe; and a first set of collars fluidly coupling said cross-pipe to said first intermediate pipe, said first set of collars comprising an upper collar coupled to said cross-pipe and a lower collar coupled to said first intermediate pipe, said first supplementary pipe having a first end couplable to said upper collar and a second end couplable to said lower collar, each of said upper and lower collars having a projecting portion threadably couplable to an associated one of said first and second ends of said first supplementary pipe.

8. The assembly of claim 7, further comprising:

said intermediate pipes including a second intermediate pipe;

said supplementary pipes including a second supplementary pipe;

a second set of collars fluidly coupling said cross-pipe to said second intermediate pipe, said second set of collars comprising a top collar coupled to said cross-pipe and a bottom collar coupled to said second intermediate pipe, said second supplementary pipe having a first end couplable to said top collar and a second end couplable to said bottom collar, each of said top and bottom collars having a projecting portion threadably couplable to an associated one of said first and second ends of said second supplementary pipe.

9. The assembly of claim 7, further comprising a first coupler fluidly coupling a first end of said first intermediate pipe to a first end of said cross-pipe, said first end of said first intermediate pipe being threadably couplable to said first coupler.

10. The assembly of claim 8, further comprising a second coupler fluidly coupling a first end of said second intermediate pipe to a second end of said cross-pipe, said first end of said second intermediate pipe being threadably couplable to said second coupler.

11. The assembly of claim 7, further comprising a first connector fluidly coupling said first base pipe to said first intermediate pipe, said first connector having a medial portion threadably couplable to a second end of said first intermediate pipe, said first connector being T-shaped.

12. The assembly of claim 8, further comprising a second connector fluidly coupling said second base pipe to said second intermediate pipe, said second connector having a medial portion threadably couplable to a second end of said second intermediate pipe, said second connector being T-shaped.

13. The assembly of claim 6, further comprising a third connector fluidly coupling said cross-pipe to said valve, said third connector being T-shaped.

14. The assembly of claim 1, further comprising a plurality of end caps, said end caps comprising a first set of end caps coupled to opposite ends of said first base pipe and a second set of end caps coupled to opposite ends of said second base pipe, said end caps being removably coupled to associated ones of said base pipes wherein said end caps are configured to drain fluid from said conduit when said end caps are removed from said associated base pipes.

15. The assembly of claim 14, further comprising said end caps being threadably coupled to said base pipes.

16. The assembly of claim 9, further comprising said first coupler being arcuate.

17. The assembly of claim 10, further comprising said second coupler being arcuate.

18. A fluid-filled barrier assembly comprising:

a plurality of pipes coupled together to define a barrier, each of said pipes being removably coupled to an adjacently positioned one of said pipes, said plurality of pipes including;

a pair of base pipes, said base pipes comprising a first base pipe and a second base pipe, said base pipes being configured for positioning on a supporting surface;

a cross-pipe coupled to and extending between said base pipes;

a pair of intermediate pipes, each of said intermediate pipes being coupled to and extending vertically between said cross-pipe and an associated one of said base pipes, said intermediate pipes comprising a first intermediate pipe and a second intermediate pipe, each of said base pipes being pivotally coupled to an associated one of said intermediate pipes; and a pair of supplementary pipes, each of said supplementary pipes being coupled to and extending between an associated one of said intermediate pipes and said cross-pipe, said supplementary pipes comprising a first supplementary pipe and a second supplementary pipe, said supplementary pipes slanting upwardly toward said cross-pipe;

a hollow interior of said barrier defining a conduit, said conduit extending through each of said pipes, said conduit being configured for receiving a fluid therein wherein the fluid retains said barrier in an upright position on the supporting surface;

an inlet port being coupled to said cross-pipe, said inlet port extending upwardly from a top side of said cross-pipe, said inlet port being configured for fluidly coupling to a fluid supply wherein fluid passes into said conduit through said inlet port;

a valve coupled to said inlet port, said valve being in fluid communication with said inlet port and said conduit wherein said valve regulates flow of the fluid through said valve;

a first set of collars fluidly coupling said cross-pipe to said first intermediate pipe, said first set of collars comprising an upper collar coupled to said cross-pipe and a lower collar coupled to said first intermediate pipe, said first supplementary pipe having a first end couplable to said upper collar and a second end couplable to said lower collar, each of said upper and lower collars having a projecting portion threadably couplable to an associated one of said first and second ends of said first supplementary pipe;

a second set of collars fluidly coupling said cross-pipe to said second intermediate pipe, said second set of collars comprising a top collar coupled to said cross-pipe and a bottom collar coupled to said second intermediate pipe, said second supplementary pipe having a first end couplable to said top collar and a second end couplable to said bottom collar, each of said top and bottom collars having a projecting member threadably couplable to an associated one of said first and second ends of said second supplementary pipe;

a first coupler fluidly coupling a first end of said first intermediate pipe to a first end of said cross-pipe, said first end of said first intermediate pipe being threadably couplable to said first coupler, said first coupler being arcuate;

a second coupler fluidly coupling a first end of said second intermediate pipe to a second end of said cross-pipe, said first end of said second intermediate pipe being threadably couplable to said second coupler, said second coupler being arcuate;

a first connector fluidly coupling said first base pipe to said first intermediate pipe;

a second connector fluidly coupling said second base pipe to said second intermediate pipe, each of said first and second connectors having a medial portion, said medial portion of said first connector being threadably couplable to a second end of said first intermediate pipe, said medial portion of said second connector being threadably couplable to a second end of said second intermediate pipe;

a third connector fluidly coupling said cross-pipe to said valve, each of said first connector, said second connector and said third connector being T-shaped;

a plurality of end caps, said end caps comprising a first set of end caps coupled to opposite ends of said first base pipe and a second set of end caps coupled to opposite ends of said second base pipe, said end caps being removably coupled to associated ones of said base pipes wherein said end caps are configured to drain fluid from said conduit when said end caps are removed from said associated base pipes, said end caps being threadably coupled to said base pipes;

a sign mounted to said barrier, said sign being suspended from said cross-pipe;

a pair of hanging supports coupled to said cross-pipe, said hanging supports coupling said sign to said cross-pipe; and indicia being positioned on a front surface of said sign, said indicia being configured to communicate a warning message to a viewer of said front surface.

19. A fluid-filled barrier assembly comprising:

a plurality of pipes coupled together to define a barrier, said barrier being configured for mounting a sign thereto;

a hollow interior of said barrier defining a conduit, said conduit extending through each of said pipes, said conduit being configured for receiving a fluid therein wherein the fluid retains said barrier in an upright position on a supporting surface;

a pair of base pipes, said base pipes comprising a first base pipe and a second base pipe, said base pipes being configured for positioning on a supporting surface;

a cross-pipe coupled to and extending between said first and second base pipes; and a plurality of end caps, said end caps comprising a first set of end caps coupled to opposite ends of said first base pipe and a second set of end caps coupled to opposite ends of said second base pipe, said end caps being removably coupled to associated ones of said base pipes wherein said end caps are configured to drain fluid from said conduit when said end caps are removed from said associated base pipes.

* * * * *